US006361362B1

(12) United States Patent
Kressmann et al.

(10) Patent No.: US 6,361,362 B1
(45) Date of Patent: Mar. 26, 2002

(54) ARRANGEMENT WITH TWO HALF-PLUGS FOR SECURING IN A WALL

(75) Inventors: Markus Kressmann, Frankfurt; Andreas Machill, Idstein, both of (DE)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/011,047

(22) PCT Filed: Aug. 16, 1996

(86) PCT No.: PCT/IB96/00805

§ 371 Date: Jun. 4, 1998

§ 102(e) Date: Jun. 4, 1998

(87) PCT Pub. No.: WO97/08783

PCT Pub. Date: Mar. 6, 1997

(30) Foreign Application Priority Data

Aug. 22, 1995 (DE) ..... 195 30 846
Mar. 7, 1996 (DE) ..... 196 08 899

(51) Int. Cl.[7] ..... H01R 13/66
(52) U.S. Cl. ..... 439/555; 439/157
(58) Field of Search ..... 439/555, 557, 439/157, 347, 559, 271, 273, 544, 545

(56) References Cited

U.S. PATENT DOCUMENTS

| | | | | |
|---|---|---|---|---|
| 5,037,325 A | | 8/1991 | Wirkus | 439/467 |
| 5,249,982 A | * | 10/1993 | Funck et al. | 439/557 X |
| 5,588,858 A | * | 12/1996 | Lester et al. | 439/555 X |
| 5,626,493 A | * | 5/1997 | Post et al. | 439/555 OR |
| 5,967,824 A | * | 10/1999 | Neal et al. | 439/157 X |

FOREIGN PATENT DOCUMENTS

| | | |
|---|---|---|
| DE | 1 098 565 | 2/1961 |
| DE | 31 46 874 A1 | 6/1983 |
| DE | 36 45 179 C2 | 9/1986 |
| DE | 87 00 209 | 6/1987 |
| DE | 40 40 748 A1 | 4/1991 |
| EP | 0 581 638 A1 | 2/1994 |
| EP | 0 615 315 A2 | 9/1994 |
| EP | 0 667 654 A2 | 8/1995 |

OTHER PUBLICATIONS

See PCT International Search Report for any references that are not enclosed herewith.

* cited by examiner

*Primary Examiner*—Renee Luebke
*Assistant Examiner*—Briggitte R. Hammond

(57) ABSTRACT

The invention relates to an arrangement with two half-plugs for securing in a wall, in which the first half-plug (1) has two elastic arms (2,3) on opposite sides. It also has a stop (5) as far as which the half-plugs may be inserted into an aperture in the wall (6). Each of the two elastic arms (2,3) has an engagement projection (7,8) fitted in such a way that the projections engage on the opposite side of the wall (6) to the stop (5) if the first half-plug (1) is inserted into the wall as far as the stop (5). The second half-plug (9) also has two projecting arms (10,11) which are fitted in such a way that, when the half-plugs (9,1) are fitted together, the arms (10,11) engage in the space between the elastic arms (2,3) and the plug housing and secure the first plug by fixing the spring arms in the wall. One half-plug (9) has an actuating slide (12) with pins (13,14) and the other half-plug (1) has a corresponding guide slot (15,16), so that, when the actuating slide (12) is operated to secure the half-plugs (1,9), the pins (13,14) are moved through the guide slot (15,16). The projecting arms (10,11) of the second half-plug (9) are designed so that the pins (13,14) engage in the guide slot (15,16) only once the arms (10,11) are already engaged in the intermediate space.

10 Claims, 3 Drawing Sheets

ARRANGEMENT WITH TWO HALF-PLUGS FOR SECURING IN A WALL

BACKGROUND OF THE INVENTION

1. Field of the Invention

The invention relates to a connector assembly having two connector halves for fixing in a printed circuit board, a housing or another type of wall.

2. Summary of the Prior Art

EP 667 654 A2 discloses an assembly having two connector halves, one connector half having an actuating slide having a guide groove or a guide slot, and the other connector half correspondingly having a pin, the pin being moved through the guide slot or the guide groove during actuation of the actuating slide in order to connect the connector halves. Such an assembly is particularly helpful in plugging multi-pole connectors, since it is thereby made easier to apply the insertion force. A similar electric connector assembly having a control surface system has also been disclosed in DE 36 45 179 C2.

DE 40 40 748 C2 discloses an electric plug-and-socket device which ensures satisfactory fastening of a pair of connecting elements one to another. The plug-and-socket device comprises a pair of connecting elements and a fastening frame having a through hole which is defined by a pair of side walls. The connecting elements can move along the side walls in a fastening direction and in a direction perpendicular thereto. The plug-and-socket device comprises a guide mechanism which causes one of the connecting elements gradually to approach the other and to connect itself thereto until a state of complete connection is reached. The guiding mechanism has guide grooves, and the connector halves have corresponding pins which cooperate as in the case of an actuating slide. The fastening frame is fastened in a printed circuit board of a vehicle body.

The use of resilient arms with latching noses to secure a first part to a second part is known. It is also known to secure the resilient arms by means of further elements. DE 31 46 874 A1 has disclosed a connector having means for fastening to a frame part, locking noses being provided, and a complementary connector having a tongue which grips the locking noses behind and prevents the noses from being loosened from their latched position. It has also been disclosed, in DE-AS 1 098 565, to provide on opposite sides of a first connector half resilient arms which engage in an opening, for example in a printed circuit board, and are secured through the housing of the second connector.

SUMMARY OF THE INVENTION

It is the object of the invention to specify an assembly having two connector halves for fixing in a wall, which is of simple construction and permits reliable fixing in the wall without additional loose elements.

The object is achieved by means of an assembly having the features of the independent claims. Advantageous developments are specified in the subclaims.

The assembly has two connector halves, one connector half having an actuating slide having a guide groove or a guide slot or a pin, and the other connector half correspondingly having a pin or a guide groove or a guide slot, the pin being moved through the guide slot or the guide groove during actuation of the actuating slide in order to connect the connector halves. Furthermore, the first connector half has at least one resilient arm which extends to the side from the connector housing. Again, the first connector half has a stop.

The first connector half can be inserted up to this stop through an opening in a wall. The resilient arm on the first connector half has in each case at least one latching nose. The latching nose is fitted in such a way that it latches tight on the side of the wall opposite the stop, if the first connector half is inserted into the wall up to the stop. The second connector half likewise has at least one projecting arm. This arm is fitted in such a way that when the two connector halves are joined the arm of the second connector half engages in the clearance between the resilient arm and the connector housing of the first connector half and fixes the resilient arm of the first connector half. This ensures that the connector pair is held securely on a wall. The wall of a housing, or a plate, or else a printed circuit board is conceivable as the wall.

It is particularly advantageous when the first connector half has at least one resilient arm on two opposite sides, and the second connector half likewise correspondingly has at least one projecting arm on two opposite sides. In addition to the secure holding, by virtue of the feature that the projecting arms of the second connector half are constructed in such a way that the pins do not engage in the guide slot until the arms engage in the clearance, it is ensured that the actuating slide cannot be actuated if the first connector half is not actually latched in the opening in the printed circuit board.

Since a high force can be applied when using the actuating slide, it would be possible to damage the arms were it possible to actuate the actuating slide before the projecting arms of the second connectors enter between the arms and the housing of the first connector half. It is therefore important to stipulate precisely how the sequence of entrance is performed. It is particularly advantageous that the projecting arms already engage in the clearance before the pins engage in the guide slot. This can be achieved by way of example and in a particularly advantageous way when the free ends of the arms are located in the same plane (perpendicular to the plug-in direction) as the pins, and when the entrance opening of the guide slots is located in the plane of the wall. It is then ensured that the arms have a leading action and the actuating slide can be actuated only if the first connector is latched correctly in the opening of the wall, for example of the printed circuit board.

If the actuating slide has complementary means which permit it to latch tight in two positions in the corresponding connector half, it is particularly advantageous that the connection of the two connector halves to the wall is also secured by the latching mechanism in the end position in which the connector halves are connected.

Figure 1:
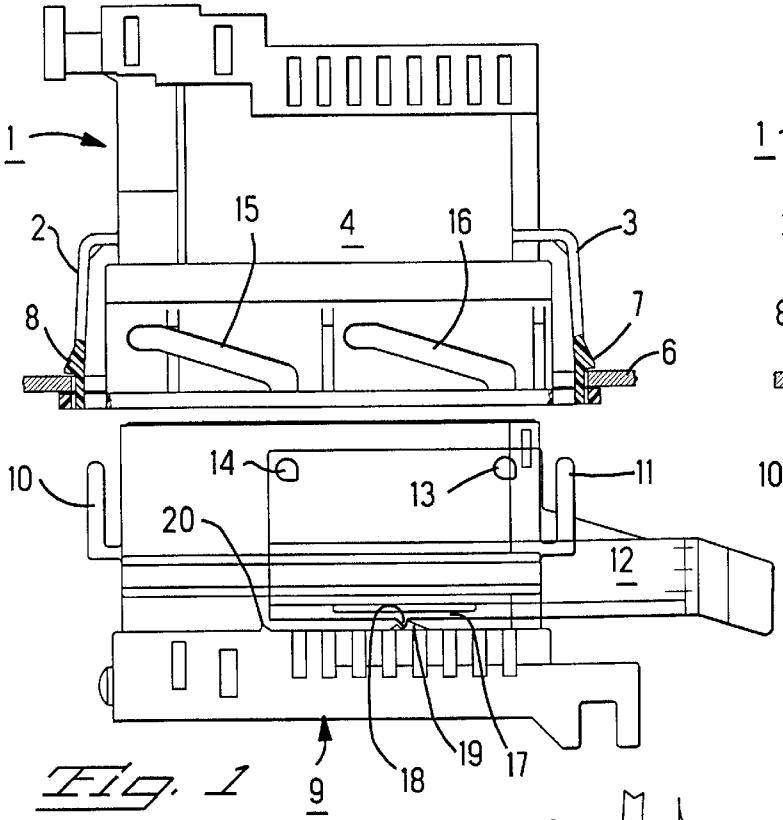
FIG. 1 shows a side view of the two connector halves to be joined.
Figure 1A:
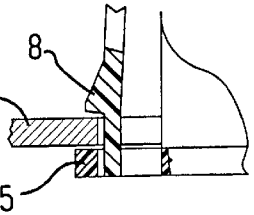
FIG. 1*a* shows a view of a detail of the latching of the first connector half of FIG. 1.

A first connector half 1 and a second connector half 9 are respectively represented in a side view in FIG. 1. The first connector half 1 has a connector housing 4. The connector housing 4 is provided on its narrow sides with two resilient arms 2, 3 which each arm have a latching nose 7, 8, in each case. The connector housing 4 further has a stop 5 (FIG 1*a*). Furthermore, two guide slots 15, 16 are provided on the outer walls of the connector housing 4. The connector housing 4 can be inserted into a wall 6 up to the stop 5 through an opening in said wall. When the connector half 1 is inserted into the wall 6 up to the stop 5, the latching noses 7, 8 of the arms 2, 3 grip behind the wall behind in this position. The result of this is to prevent the connector half 1 from being able to fall out of the wall 6 again.

The second connector half 9 has an actuating slide 12 which can be moved outside on the housing on a guide rail. The actuating slide has two pins 13 and 14. Furthermore, a resilient carrier 17 having a latching nose 18 is provided on the actuating slide. Corresponding latching structures 19 and 20 are provided on the housing of the second connector part 9. If the latching nose 18 latches tight in the structure 19, the actuating slide 12 is fixed in the entrance position. If the actuating slide 12 latches tight behind the latching nose 20, it is fixed in the end position. Arms 10 and 11 are fitted laterally on the housing of the second connector half 9.

Figure 2:
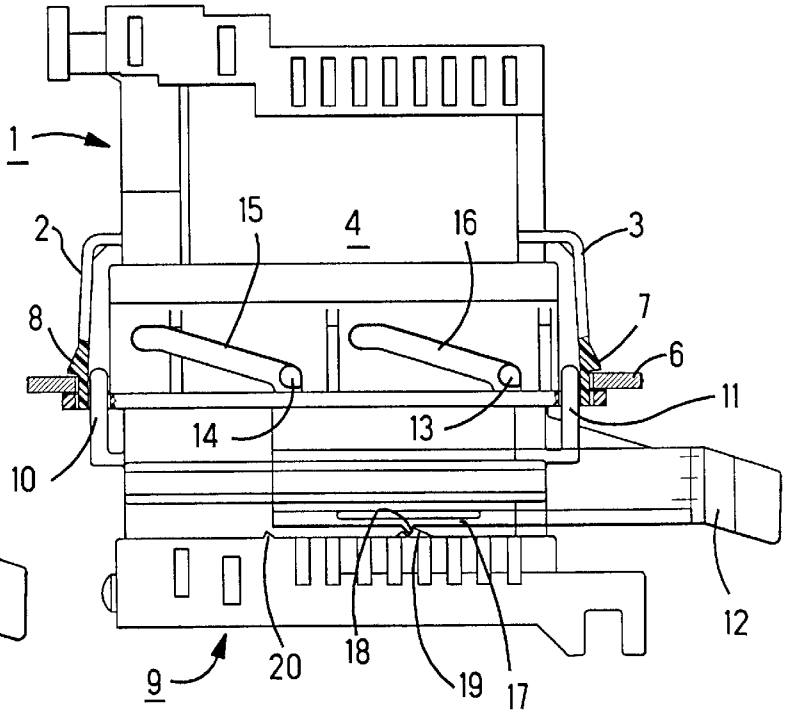
FIG. 2 shows the two connector halves of FIG. 1 in a side view, the pins already being inserted in the guide slots.
Figure 2B:
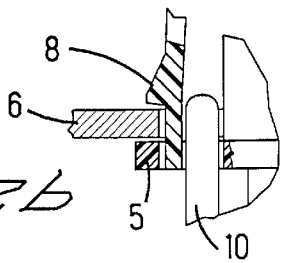
FIG. 2*a* shows a view of a detail of the latching in FIG. 2.
Figure 3:
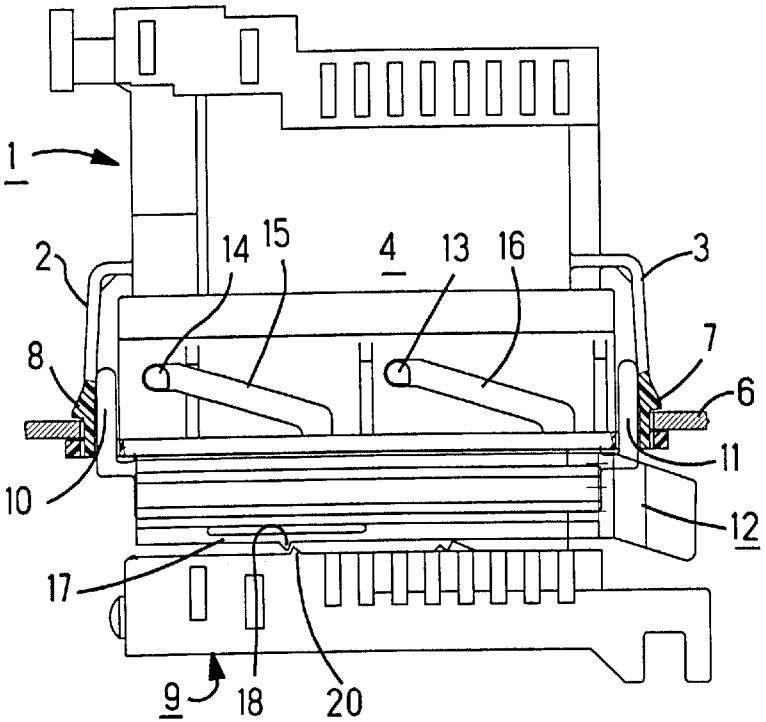
FIG 3 shows a side view of the two joined connector halves of FIG. 1 joined together.
Figure 3A:
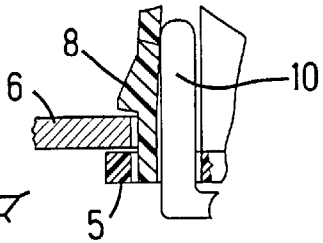
FIG. 3*a* shows a view of a detail of the latching of FIG. 3.

The mode of operation during joining of the connector halves is now explained with the aid of FIGS. 2 and 3. FIG. 2 shows that the arms 10, 11 on the second connector half 9 are already located in the clearance between the arms 2, 3 of the first connector half and the housing 4 of the first connector half 1. At the same time, the actuating slide 12 is located in the entrance position on the second connector half 9 in such a way that the two pins 13 and 14 of the actuating slide can be inserted in the guide slots 15 and 16. The two connector halves 1,9 thus engage in one another by means of the actuating slide 12 only if the arms 10 and 11 can also engage in the clearances between the arms 2 and 3 and the housing 4. By actuating the actuating slide 12 in the direction of the double arrow represented in FIG. 2, the pins 13, 14 are moved along the guide slots 15, 16. The connector halves 9 and 1 are thereby joined. The joined state is represented in FIG. 3. The actuating slide 12 is located in the end position. The pins 13, 14 have arrived at the end of the guide slots 15, 16. In addition, the arms 10, 11 of the second connector half 9 engage between the resilient arms 2, 3 of the first connector half 1 and the housing 4 of the first connector half. The resilient arms 2, 3 are fixed as a result. It is impossible to remove the two joined connectors from the wall 6 without removing the second connector half 9 from the first connector half 1.

Figure 4:
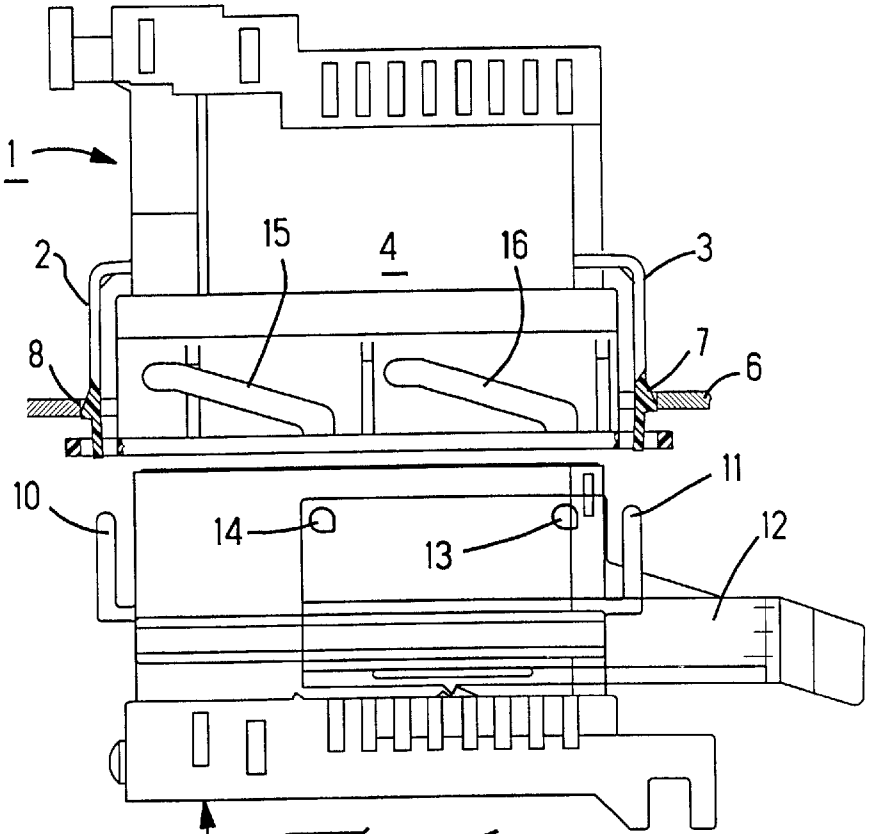
FIG. 4 shows a side view of the two connector halves of FIG. 1 to be joined, the first connector half being improperly latched in the wall.
Figure 4A:
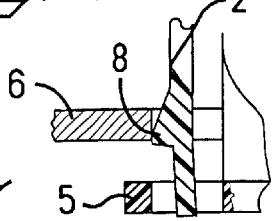
FIG. 4*a* shows a view of a detail of the latching in FIG. 4.
Figure 5:
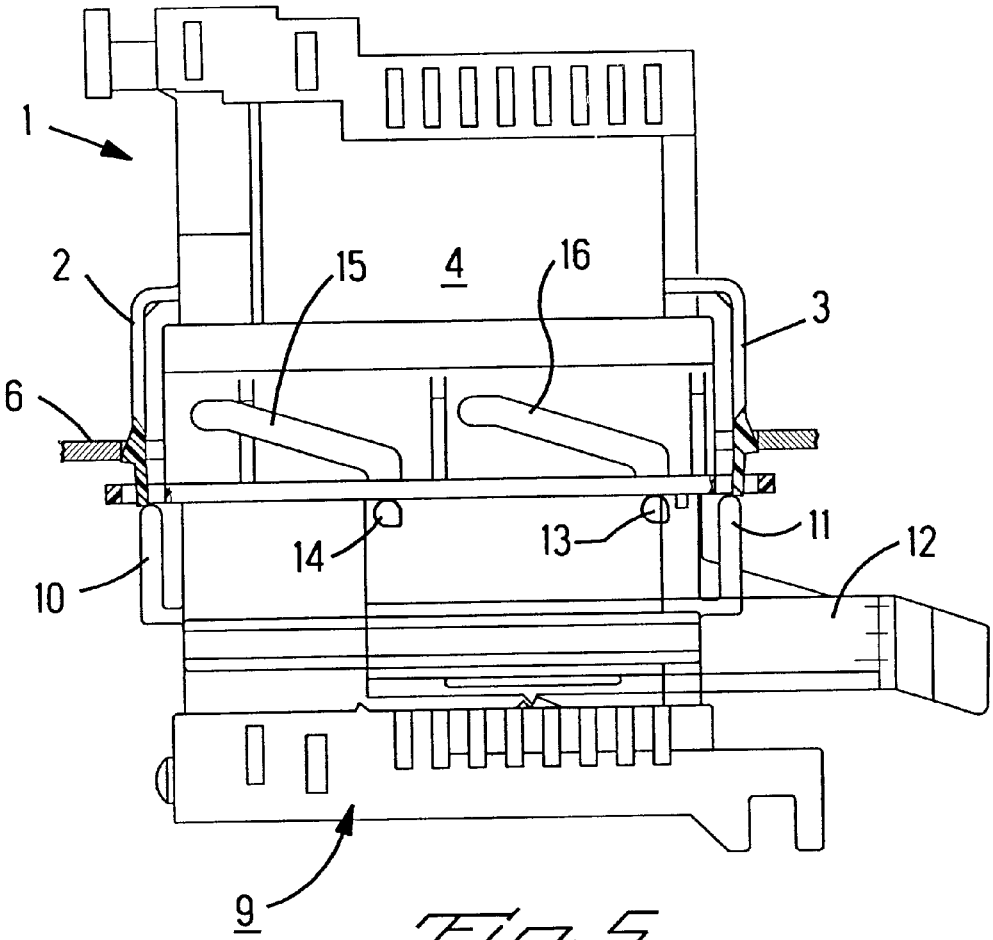
FIG. 5 shows a side view of the two connector halves to be joined to FIG. 4, it being possible not to insert the second connector half in the first connector half.
Figure 5A:
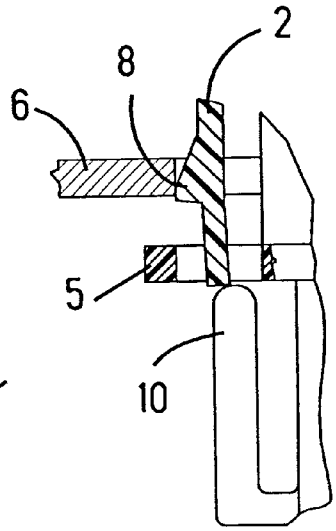
FIG. 5*a* shows a view of a detail of the latching in FIG. 5.

The connector halves represented in the previous figures are represented once more in FIGS. 4, 4*a*, 5 and 5*a*, these figures illustrating a situation of faulty installation. Identical parts are provided in all the figures with identical reference symbols. It is shown in FIG. 4 that the first connector half 1 is incorrectly inserted in the wall 6. As is to be seen from the drawing of the detail in FIG. 4*a*, the latching nose 8 is not latched above the wall 6, but is located in the through opening. If an attempt is now made, as represented in FIGS. 5 and 5*a*, to connect the second connector half 9 to the first connector half, the arms 10 and 11 cannot be inserted in the clearance between the arms 2 and 3 and the housing 4 on the first connector half 1. This is represented with particular clarity in FIG. 5*a*. Actuating the actuating slide does not now have the effect that the two connector halves 1 and 9 are moved onto one another, since the pins 13 and 14 do not engage with the guide slots 15 and 16. It is therefore ensured that the actuating slide is not actuated by force and that the arms 10 and 11 are correspondingly bent, which could be the case if the latter are constructed too short. The pins 13, 14 on the actuating slide are likewise ensured against being damaged or torn off.

What is claimed is:

1. An assembly comprising two connector halves for mounting to a panel, a first connector half having guide grooves, and a second connector half having pins, the pins being moved through the guide grooves in order to connect the two connector halves, the connector housing of the first connector half, the first connector half having at least one stop which extends from the first connector housing, the at least one stop cooperates with the panel to properly position the first connector half relative to the panel, the at least one resilient arm having a latching nose which is fitted in such a way that the latching nose and the at least one stop cooperate to maintain the panel therebetween, the second connector half having at least one projecting arm which is fitted in such a way that when the two connector halves are joined the at least one projecting arm is positioned between and engages the at least one resilient arm and an first connector housing and prevents the movement of the at least one resilient arm away from the panel, whereby when the two connector halves are joined together, the first connector half is secured to the panel by the operation of the at least one resilient arm, the at least one stop and the at least one projecting arm, and the pins engage in the guide grooves.

2. An assembly comprising two connector halves for mounting to an opening of a substrate, a one of the connector halves having an actuating slide having a pin, and an other of the connector halves having a guide groove which corresponds to the pin, the pin being moved through the guide groove during actuation of the actuating slide in order to connect the two connector halves, the other of the connector halves having at least one resilient arm which extends to a side from a first connector housing of the other of the connector halves, the one of the connector halves having a stop which cooperates with the substrate proximate the opening to properly position the other of the connector halves relative to the substrate, the at least other resilient arm having at least one latching nose which is fitted in such a way that the at least other latching nose and the stop cooperate to maintain the substrate therebetween when the one of the connector halves is properly positioned in the opening of the substrate, the one of the connector halves having at least one projecting arm which is fitted in such a way that when the two connector halves are joined that at least one projecting arm is positioned between the at least one resilient arm and the first connector housing and prevents the at least one latching nose of the at least one resilient arm from disengaging the substrate, and the at least one projecting arm of the one of the connector halves being constructed in such a way that the pin engages in the guide groove when the at least one projecting arm is positioned between the at least one resilient arm and the first connector housing.

3. The assembly according to claim 2, whereby the other of the connector halves has at least one resilient arm on two opposite sides, and the one of the connector halves correspondingly has at least one projecting arm on two opposite sides.

4. The assembly according to claim 2, wherein the at least one projecting arm of the one of the connector halves is constructed in such a way that the pin does not engage in the guide groove until the at least one projecting arms has already been inserted partly between the at least one resilient arm and the first connector housing.

5. The assembly according to claim 2, wherein the pin and free ends of the at least one projecting arm are located in the same plane, and a mating opening of the guide groove is located in the plane of the substrate.

6. The assembly according to claim 2, wherein the actuating slide and the one of the connector halves have complementary latching structures which cooperate with the actuating slide to latch the actuating slide in two positions, an entrance position, in which the pin can be inserted in the guide groove, and an end position, in which the pin is positioned in the guide groove and the two connector halves are connected.

7. The assembly according to claim 6, wherein the latching structures are constructed in such a way that, from the entrance position, the actuating slide can be removed from the other of the connector halves only with difficulty, and the actuating slide can easily be moved between the entrance position and the end position.

8. An assembly comprising two connector halves for fixing in a wall, a first connector half having an actuating slide that engages a second connector half where actuation of the actuating slide connects the two connector halves, the second connector half has at least one resilient arm which extends to the side from a second connector housing of the second connector half, a stop is positioned proximate the at least one resilient arm, the stop cooperating with the wall to properly position the second connector half therein, the at least one resilient arm has at least one latching nose that latches on a first side of the wall opposite a second side of the wall with which the stop cooperates with when the second connector half is inserted into the wall up to the stop, and the first connector half has at least one projecting arm that, when the two connector halves are joined, the at least one projecting arm engages in a clearance between the at least one resilient arm and the second connector housing to fix the at least one resilient arm, where the at least one projecting arm of the first connector half is constructed in such a way that the at least one projecting arm must be positioned in the clearance in order for the actuating slide to engage the second connector.

9. The assembly according to claim 8, wherein the second connector half has at least one resilient arm on two opposite sides, and the first connector half likewise has at least one corresponding projecting arm on two opposite sides.

10. The assembly according to claim 8, wherein the at least one projecting arm of the first connector half is constructed in such a way that pins provided on the actuating slide do not engage guide slots positioned on the second connector half until the at least one projecting arm has been inserted partly into the clearance.

* * * * *